US007642438B1

(12) United States Patent
Cohen

(10) Patent No.: US 7,642,438 B1
(45) Date of Patent: Jan. 5, 2010

(54) NOVELTY NOISE MAKING DEVICE

(76) Inventor: Wayne Cohen, 43/40 Soi Phraya Piren, Rama IV Road, Thungmahamck, Sathorn 10120 (TH)

( * ) Notice: Subject to any disclaimer, the term of this patent is extended or adjusted under 35 U.S.C. 154(b) by 0 days.

(21) Appl. No.: 11/654,702

(22) Filed: Jan. 19, 2007

(51) Int. Cl.
*G10D 7/00* (2006.01)
*A63H 3/31* (2006.01)

(52) U.S. Cl. ..... 84/330; 446/184; 446/188; 446/192; 446/193; 446/207

(58) Field of Classification Search ..... 84/380 B, 84/330; 446/192, 193, 207, 184, 188, 489
See application file for complete search history.

(56) References Cited

U.S. PATENT DOCUMENTS

| | | | | | |
|---|---|---|---|---|---|
| 305,213 | A | * | 9/1884 | Maurise | 446/193 |
| 403,702 | A | * | 5/1889 | Sellers | 446/192 |
| 455,671 | A | * | 7/1891 | Sellers | 446/192 |
| 482,786 | A | * | 9/1892 | Crocker | 446/193 |
| 677,113 | A | * | 6/1901 | Bruce | 446/193 |
| 2,782,558 | A | | 2/1957 | Harley | 46/180 |
| 2,817,187 | A | * | 12/1957 | Auzin | 446/184 |
| 3,002,318 | A | * | 10/1961 | Carver | 446/144 |
| 3,282,144 | A | * | 11/1966 | Knott | 84/375 |
| 3,691,675 | A | * | 9/1972 | Rodgers | 446/188 |
| 3,774,572 | A | * | 11/1973 | Borraccio | 116/67 R |
| 3,813,811 | A | * | 6/1974 | Herter | 446/193 |
| 3,900,993 | A | * | 8/1975 | Betters | 446/193 |
| 3,941,081 | A | * | 3/1976 | Nakamura | 116/142 FP |
| 4,114,501 | A | * | 9/1978 | Tanaka | 84/330 |
| 4,121,373 | A | * | 10/1978 | Slowe et al. | 446/193 |
| 4,271,744 | A | * | 6/1981 | Kulesza | 84/330 |
| 4,371,278 | A | * | 2/1983 | Joo | 401/195 |
| 4,539,888 | A | * | 9/1985 | Whelan | 84/380 B |
| 4,583,957 | A | * | 4/1986 | Levy | 446/177 |
| 4,981,314 | A | * | 1/1991 | Carr | 292/347 |
| 5,310,380 | A | * | 5/1994 | Levy et al. | 446/489 |
| D354,689 | S | * | 1/1995 | Figard | D19/36 |
| 5,522,756 | A | * | 6/1996 | Barthold | 446/193 |
| 5,571,037 | A | * | 11/1996 | Sellers | 446/188 |
| 5,803,785 | A | * | 9/1998 | Primos et al. | 446/207 |
| 6,031,168 | A | * | 2/2000 | Damm | 84/380 B |
| 6,240,671 | B1 | * | 6/2001 | Galfidi, Jr. | 42/90 |

(Continued)

OTHER PUBLICATIONS

Quackler Noisemaker, at GraphicIce.com © 2006, viewed Jul. 28, 2008 at http://graphicice.com/index.php/action/prodspec/itemID/782239875.*

(Continued)

*Primary Examiner*—Jeffrey Donels
*Assistant Examiner*—Robert W Horn
(74) *Attorney, Agent, or Firm*—LaMorte & Associates

(57) ABSTRACT

A novelty noisemaker assembly and its associated method of assembly. The noisemaker assembly has a bellows for manually producing a flow of air. Air from the bellows passes through a sound generator that produces sound energy as the air passes. The sound energy from the sound generator passes into a pitch control chamber. A plurality of slots are formed in the sound generator. A secondary object is coupled to the end of the pitch control chamber. The secondary object obstructs the pitch control chamber. Consequently, the slots in the side of the pitch control chamber provide the only exit port for the flow of air created by the bellows and the sound energy created by the sound generator.

17 Claims, 4 Drawing Sheets

U.S. PATENT DOCUMENTS

| | | | | |
|---|---|---|---|---|
| D448,409 | S * | 9/2001 | Schimmel | D19/57 |
| 6,422,912 | B1 * | 7/2002 | Summers | 446/184 |
| 6,575,804 | B1 * | 6/2003 | Primos | 446/202 |
| 2001/0034177 | A1 * | 10/2001 | Hunn | 446/73 |

OTHER PUBLICATIONS

Logoed Noisemaker at Branders.com (annoted zoom view), viewed Jul. 28, 2008 at http://www.branders.com/s/Logoed-Noisemaker---Quackler-zoom-73715.html.*

Maraca Pen, at GraphicIce.com © 2006, viewed Jul. 28, 2008 at http://graphicice.com/index.php/action/prodspec/itemID/161978472/.*

Whistle Pen, at GraphicIce.com © 2006, viewed Jul. 28, 2008 at http://graphicice.com/index.php/action/prodspec/itemID/122180851/.*

Latin Percussion turns 30: how Martin Cohen and family turned Americans on the a Latin beat and built a thriving business along the way, Music Trades, Nov. 1994, Entrepreneur .com, viewed Jan. 13, 2009 at: http://www.entrepreneur.com/tradejournals/article/print/16437446.html.*

Bongo Logic Company website, © 2007, viewed Jan. 13, 2008 at www.bongologic.com/promo.php and www.bongologic.com/company_profiles.php, shows details of company and patents arround the world.*

* cited by examiner

NOVELTY NOISE MAKING DEVICE

BACKGROUND OF THE INVENTION

1. Field of the Invention

In general, the present invention relates to noise making devices that make noise by passing air across a vibrating element. More particularly, the present invention device relates to novelty noise making devices that have a self-contained bellow structure for creating the flow of air needed to create noise.

2. Prior Art Description

The prior art is replete with novelty devices that are designed to make noise. One class of such novelty devices is the vibrating element noisemaker. A vibrating element noisemaker typically has a conduit through which air passes. A vibrating element is placed in the conduit so that the vibrating element vibrates and makes noise as air runs through the conduit.

In many designs, the air that passes through the conduit and excites the vibrating element is created by blowing into the conduit. This is often the design of novelty instrument noisemakers, such as kazoos and harmonicas, that are played at the mouth. Other noisemakers rely upon a bellows to generate the air needed to excite the vibrating element and make noise. The bellows can take many forms. For instance, there are many novelty balls that make noise when the ball is squeezed. In such toys, the structure of the ball is the bellows and the vibrating element is a small structure positioned in a vent of the ball.

In some prior art noisemakers, a squeeze bulb is used to create a short strong burst of air. The squeeze bulb is often corrugated to help the squeeze bulb collapse when it is squeezed. Such designs are commonly used on game calls, such as duck calls, and are exemplified by U.S. Pat. No. 2,782,558 to Harley, entitled Call Device, and U.S. Pat. No. 5,803,785 to Primos, entitled Game Call Apparatus With A Selective Disablement Mode.

Regardless of whether the vibrating element noisemaker is a ball, kazoo or duck call, all vibrating element noisemakers share some common operational characteristics. Foremost among those characteristics is the fact that the only way to vary the noise produced by the noisemaker is to vary the flow of air traveling through the noisemaker. If a loud noise is to be created, a large burst of air is used. If a soft nose is to be created, a gentle puff of air is used.

A second characteristic shared by vibrating element noisemakers is that the flow of air beyond the vibrating element cannot be constricted. In a squeeze ball there is no structure beyond the vibrating element. In both kazoos and duck calls, enlarged resonance chambers are provided to increase the volume of the noise being made. If any restriction is placed beyond the vibrating element in the noisemaker, a backpressure condition develops that limits the flow of air past the vibrating element and therefore lessens the noise.

The present invention is a novelty noisemaker that utilizes a vibrating element. However, the chamber beyond the vibrating element is specially designed to enable the noisemaker to engage a secondary object without any detrimental effect to the noisemaker's ability to make noise. This improved noisemaker design is described and claimed below.

SUMMARY OF THE INVENTION

The present invention is a novelty noisemaker assembly and its associated method of assembly. The noisemaker assembly has a bellows for manually producing a flow of air.

The bellows has an open end through which air passes. Air from the bellows passes through a sound generator that produces sound energy as the air passes. The sound energy from the sound generator passes into a pitch control chamber. The pitch control chamber is a tubular structure that extends between a first end and a second end. A plurality of slots are formed in the tubular structure between the first end and the second end.

A secondary object is coupled to the second end of the pitch control chamber. The secondary object obstructs the second end of the pitch control chamber. Consequently, the slots in the side of the pitch control chamber provide the only exit port for the flow of air created by the bellows and the sound energy created by the sound generator. By selectively covering and uncovering the slots, a user can vary both the flow of air and the tone of the sound energy.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be configured in many ways, only a few exemplary embodiments are shown. The exemplary embodiments are selected to illustrate some of the best modes contemplated for practicing the invention. However, the selection of the exemplary embodiments is arbitrary and should not be considered a limitation upon the scope of the claims.

Figure 1:
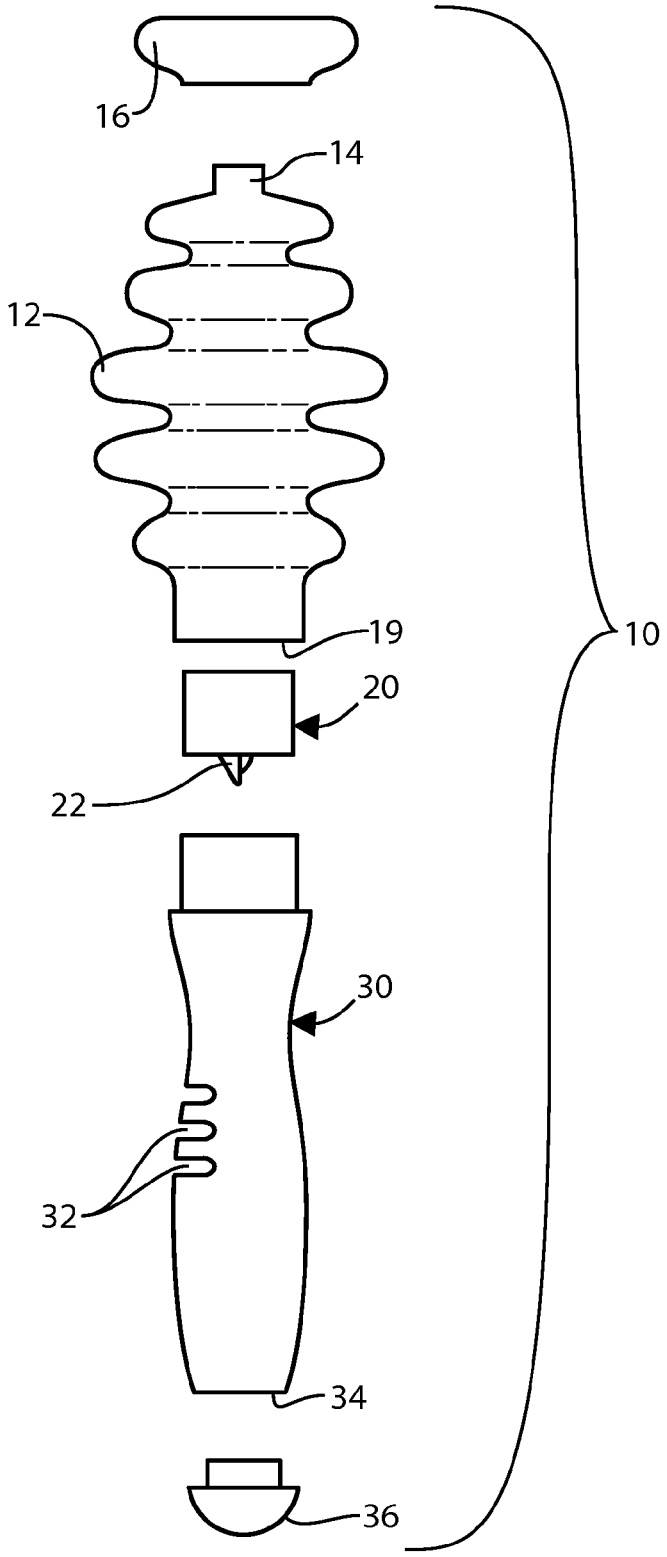
FIG. 1 is an exploded view of a first exemplary embodiment of the present invention.
Figure 2:
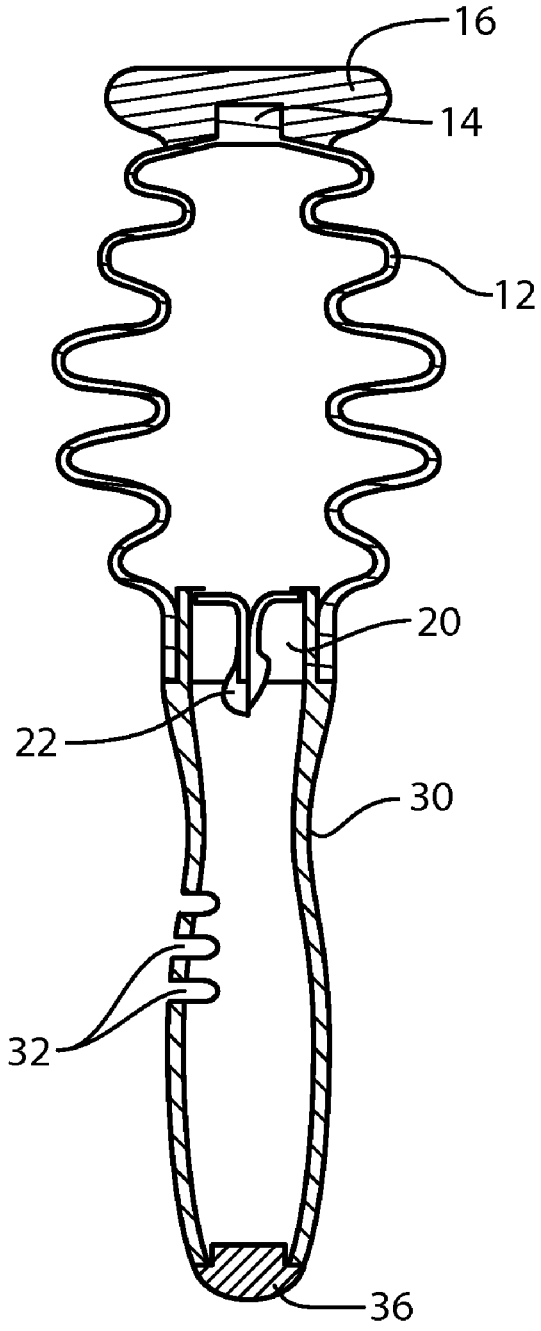
FIG. 2 is a cross-sectional view of the embodiment of FIG. 1.

Referring to both FIG. 1 and FIG. 2, a first exemplary embodiment of a noisemaker assembly 10 is shown. The noisemaker assembly 10 includes a molded bellows 12. The bellows 12 has a corrugated exterior that enables the bellows 12 to better collapse when compressed. The bellows 12 is made from a resilient material, such as silicone rubber, that enables the bellows 12 to return to its original shape after being compressed.

A neck extension 14 can be formed at the top of the bellows 12. A knob 16 is optionally provided that caps the neck extension 14. The knob 16, if present, is preferably made of a hard material, such as plastic or wood. The knob 16 provides a hard surface at the top of the bellows 12 that can be pressed upon, therein causing the entire bellows 12 to collapse. The hard knob 16 also provides a surface upon which a printed or inscribed indicia 18 can be placed. In the shown embodiment, the knob 16 is generally disc shaped. It should be understood that the knob 16 can be shaped in other ways, such as in the shapes of animals or corporate logos.

The bellows 12 has a single open end 19. Accordingly, when the bellows 12 is compressed, air contained within the bellows 12 is displaced out of the open end 19. A sound generator 20 is positioned at the open end 19 of the bellows 12. The sound generator 20 contains a vibrating element 22 that creates noise as the air from the bellows 12 flows out the open end 19 of the bellows 12. There are numerous sound generator designs known in the prior art of noisemakers. Many such prior art sound generator designs can be adapted for use as part of the present invention.

A pitch control chamber 30 is coupled to the open end 19 of the bellows 12 around the sound generator 20. All air that passes through the sound generator 20 passes into the interior of the pitch control chamber 30. The pitch control chamber 30 is a tubular structure. A plurality of parallel slots 32 are formed in the side of the pitch control chamber 30. In the illustrated embodiment, three slots 32 are shown. However, it should be understood that any plurality of slots 32 can be utilized. Furthermore, although the slots 32 are aligned in a parallel configuration, the slots 32 need not be uniform in size, although uniformity is preferred. It is also preferred that the overall areas of the openings defined by the slots 32 be generally equal to, or larger than, the area within the sound generator 20 through which air passes.

The distal end 34 of the pitch control chamber 30, opposite the bellows 12 is closed with and end cap 36. Consequently, the slots 32 in the pitch control chamber 30 provide the only vent for air to exit the pitch control chamber 30. It will therefore be understood that the same volume of air displaced out of the bellows 12 and into the pitch control chamber 30 must also flow out of the pitch control chamber 30 through the slots 32. Since the area of the slots 32 is at least as large as the airflow area of the sound generator 20, the slots 32 offer no more resistance to the flow of air than does the sound generator 20 itself. The presence of the slots 32 therefore does not create a backpressure condition that adversely effects the flow of air from the bellows 12 through the sound generator 20.

As air flows through the sound generator 20, the sound generator 20 makes noise. The noise reverberates within the pitch control chamber 30 and is emitted into the surrounding environment through the slots 32. The slots 32 do not restrict the flow of air through the sound generator 20, provided that all of the slots 32 remain unobstructed. However, if one or more of the slots 32 becomes obstructed, the area available for the free flow of air becomes less than the airflow capacity of the sound generator 20. Accordingly, a backpressure condition develops in the pitch control chamber 30 that limits the volume of air flowing through the sound generator 20. By selectively limiting the flow of air through the sound generator 20, the noise created by the sound generator 20 can be selectively controlled. It will therefore be understood that a person selectively covering the slots 32 with his/her fingers can selectively control the sound being produced by the overall noisemaker assembly 10.

The pitch control chamber 30 acts as a resonance chamber. The slots 32 are positioned at different points along the pitch control chamber 30. By selectively covering the different slots 32, the sound energy escapes the pitch control chamber 30 at different points. Accordingly, the sound released through each slot 32 will vary in pitch and tone. The overall noisemaker assembly 10 therefore has the ability to be selectively played like an instrument with specific notes being achieved at desired points in tempo.

In operation, it will therefore be understood that to operate the noisemaker assembly 10, the bellows 12 is compressed by pressing downwardly on the knob 16 atop the bellows 12. If the knob 16 is not present, the bellows 12 is directly contacted. As the bellows 12 collapses, air from within the bellows 12 is displaced through the sound generator 20. The sound generator 20 produces sound energy that is directed into the pitch control chamber 30. The user, by selectively obstructing the various slots 32 in the side of the pitch control chamber 30, can vary the pitch, tone and volume of the sound energy emanating out of the noisemaker assembly 10.

Figure 3:
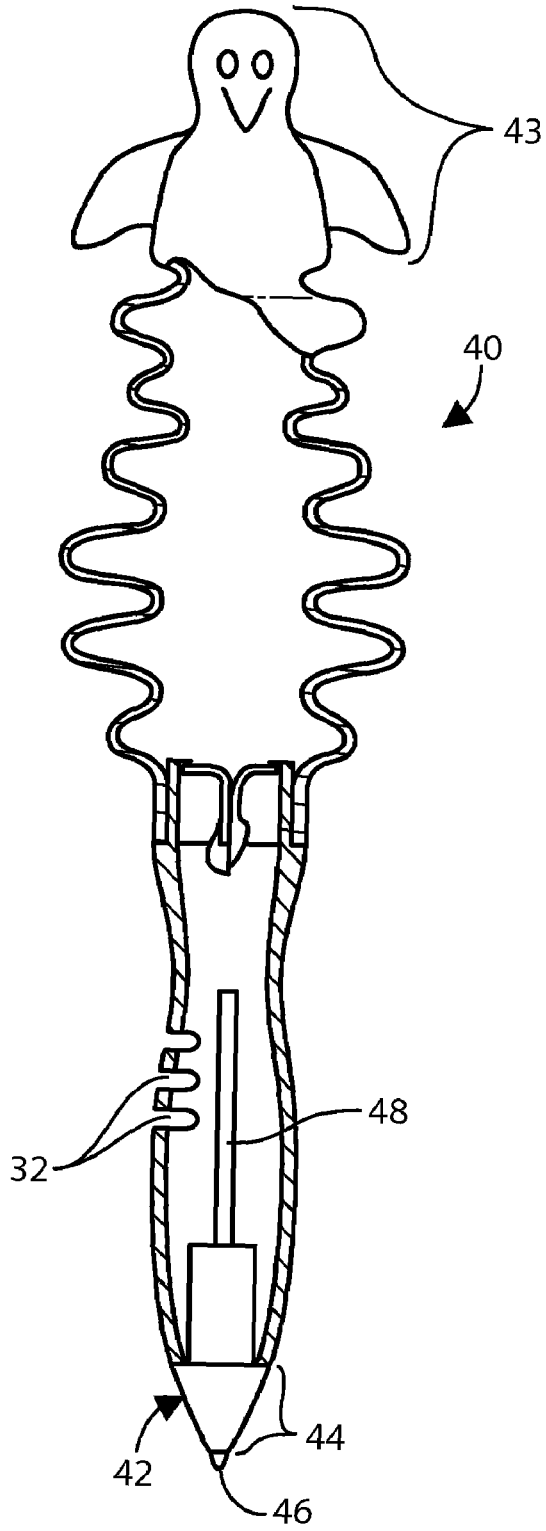
FIG. 3 is a selectively cross-sectioned view of a second exemplary embodiment of the present invention.

Referring to FIG. 3, a variation of the noisemaker assembly previously described is shown. In FIG. 3, the noisemaker assembly 40 has the same general construction as has been previously described. The exception being that the end cap (36, FIG. 2) at the distal end of the pitch control chamber 30 has been replaced with a pen subassembly 42, and the shape of the bellows 41 has been changed.

The pen subassembly 42 has a head section 44 that passes into the distal end 34 of the pitch control chamber 30, therein fully obstructing the distal end 34. The head section 44 can be held in place in the distal end 34 of the pitch control chamber 30 using threads, adhesive and/or a friction fit.

The pen subassembly 42 has a writing point 46 that can be a ballpoint or a felt tip. The pen subassembly 42 also includes an ink reservoir 48 that extends into the space of the pitch control chamber 30. The presence of the pen subassembly 42 has no effect on the flow of air into the pitch control chamber 30 and out through the slots 32. The noisemaker assembly 40, therefore, has a structure that enables it to be connected to secondary objects like the pen subassembly 42, without having adverse effects on its ability to produce noise.

The bellows 41 has been shaped so that is has a form section 43 and a standard corrugated section 45. The form section 43 has the shape of an animal, inanimate object or corporate logo. The form section can either be molded as part of the bellows 41 or attached to the end of the bellows 41 in the same manner as the cap shown in FIG. 1.

Figure 4:
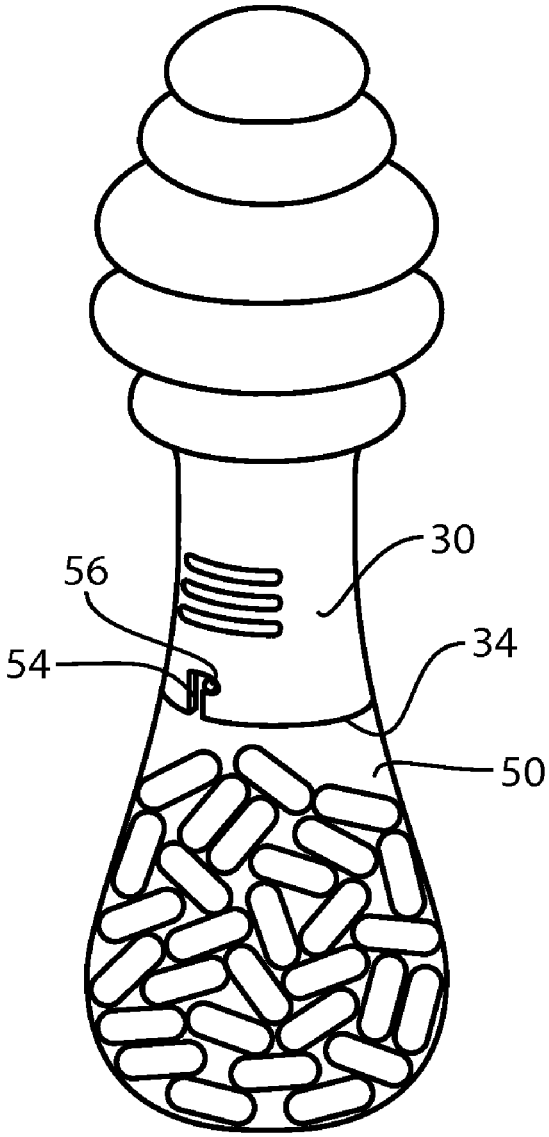
FIG. 4 is a perspective view of a third exemplary embodiment of the present invention.

Referring to FIG. 4, yet another example of the present invention is shown. In this example, a candy case 50 is used to obstruct the distal end 34 of the pitch control chamber 30. The candy case 50 holds a volume of candy 52. The candy case 50 passes into the distal end 34 of the pitch control chamber 30 where it is mechanically engaged and held in place. In the shown embodiment, locking slots 54 are shown formed in the distal end 34 of the pitch control chamber 30. The locking slots 54 receive and engage small posts 56 that protrude from the candy case 50. The use of locking slots 54 and posts 56 is merely exemplary of a variety of mechanical fasteners that can hold the candy case 50 in place.

It will be understood that the embodiments of the present invention that have been illustrated and described are merely exemplary and that a person skilled in the art can make many variations to those embodiments using functionally equivalent components. For instance, the shape and size of the bellows, sound generator and pitch control chamber can all be varied as a matter of design choice. Furthermore, any secondary object can be connected to the distal end of the pitch control chamber provided that secondary object does not interfere with the flow of air out of the slots within the pitch control chamber. All such variations, modifications and alternate embodiments are intended to be included within the scope of the present invention as defined by the claims.

What is claimed is:

1. A novelty noisemaker assembly, comprising:

a bellows having a tubular structure defined by a corrugated exterior wall that extends from a top end to an open bottom end, wherein said bellows displaces air through said open bottom end when deformed;

a knob coupled to said top end of said bellows, wherein said tubular structure of said bellows is the only support for said knob, and wherein said knob extends away from said top end and does not confine any portion of said corrugated exterior wall;

a pitch control chamber having a tubular structure that extends between a first end and a second end, wherein a plurality of slots are formed in said tubular structure of said pitch control structure between said first end and said second end;

a sound generator that produces noise when air flows therethrough, said sound generator being positioned proximate said open end of said bellows and said first end of said pitch control chamber so that air displaced by said bellows passes through said sound generator and into said pitch control chamber; and a secondary object coupled to said second end of said pitch control chamber that obstructs said second end and prevents air from flowing therethrough.

2. The assembly according to claim 1, wherein said sound generator embodies a predetermine area for air flow between said bellows and said pitch control chamber.

3. The assembly according to claim 1, wherein said plurality of slots define a total open area at least as large as said predetermined area defined by said sound generator.

4. The assembly according to claim 1, wherein said plurality of slots are arranged in parallel.

5. The assembly according to claim 1, wherein said secondary object is selectively detachable and reattachable to said second end of said pitch control chamber.

6. The assembly according to claim 1, wherein said secondary object is selected from a group consisting of end caps, pen assemblies and candy cases.

7. The assembly according to claim 1, wherein said secondary object engages said second end of said pitch control chamber with a mechanical fastener.

8. The assembly according to claim 1, wherein knob is shaped as an animal.

9. The assembly according to claim 1, wherein said bellows is shaped, at least in part, as an animal.

10. A noisemaking pen assembly, comprising:

a tubular bellows defined by a corrugated exterior wall that extends from a top end to an open bottom end, wherein said bellows displaces air through said open bottom end when deformed;

a knob coupled to said top end of said bellows, wherein said bellows is the only support for said knob, and wherein said knob extends away from said top end and does not confine any portion of said corrugated exterior wall;

a tubular structure that extends between a first end and a second end, wherein a plurality of slots are formed in said tubular structure between said first end and said second end;

a sound generator that produces noise when air flows therethrough, said sound generator being positioned proximate said open end of said bellows and said first end of said tubular structure so that air displaced by said bellows passes through said sound generator and into said tubular structure; and a pen head coupled to said second end of said tubular structure that obstructs said second end and prevents air from flowing therethrough.

11. The assembly according to claim 10, wherein said sound generator embodies a predetermined area for air flow between said bellows and said tubular structure.

12. The assembly according to claim 10, wherein said plurality of slots define a total open area at least as large as said predetermined area defined by said sound generator.

13. The assembly according to claim 10, wherein said plurality of slots are arranged in parallel.

14. A method of constructing a novelty noisemaker, said method comprising the steps of:

providing a pitch control chamber having an open first end, and an opposite open second end, wherein slots are disposed in said pitch control chamber between said first end and said second end;

providing a tubular bellows defined by a corrugated exterior wall that extends from a top end to a bottom end, wherein said bellows displaces air through said bottom end when deformed;

providing a sound generator;

connecting said sound generator to said first end of said pitch control chamber;

connecting said bottom end of said bellows to said first end of said pitch control chamber so that air displaced by said bellows passes through said sound generator and into said pitch control chamber; and connecting a secondary object to said second end of said pitch control chamber, wherein said secondary object obstructs said second end, leaving said slots as a sole exit port to said pitch control chamber.

15. The method according to claim 14, wherein said step of connecting a secondary object to said second end of said pitch control chamber includes connecting a pen assembly to second end.

16. The method according to claim 14, wherein said step of connecting a secondary object to said second end of said pitch control chamber includes obstructing said second end with and end cap.

17. The method according to claim 14, wherein said step of connecting a secondary object to said second end of said pitch control chamber includes attaching a candy case to said second end.

* * * * *